US006263797B1

(12) United States Patent
Brice

(10) Patent No.: US 6,263,797 B1
(45) Date of Patent: Jul. 24, 2001

(54) ENHANCED FLARE APPARATUS

(75) Inventor: William F. Brice, Lakewood, CA (US)

(73) Assignee: Skyblazer, Inc., Fullerton, CA (US)

( * ) Notice: Subject to any disclaimer, the term of this patent is extended or adjusted under 35 U.S.C. 154(b) by 0 days.

(21) Appl. No.: 09/223,520

(22) Filed: Dec. 30, 1998

(51) Int. Cl.[7] ..... F42B 4/26

(52) U.S. Cl. ..... 102/346; 102/336; 102/340; 102/342

(58) Field of Search ..... 102/336, 340, 102/342, 346

(56) References Cited

U.S. PATENT DOCUMENTS

| | | | | |
|---|---|---|---|---|
| Re. 8,167 | | 4/1878 | Very | 102/336 |
| 190,263 | | 5/1877 | Very | 102/346 |
| 217,115 | | 7/1879 | Kendall | 102/346 |
| 231,705 | | 8/1880 | Faure et al. | 102/346 |
| 630,477 | | 8/1899 | Behr | 102/346 |
| 784,977 | | 3/1905 | Bowly | 102/346 |
| 2,459,687 | | 1/1949 | Decker | 102/37.7 |
| 3,062,144 | | 11/1962 | Hori et al. | 102/336 X |
| 3,349,707 | | 6/1967 | Wortley, Jr. et al. | 102/37.6 |
| 3,611,935 | | 10/1971 | Beckes et al. | 102/37.7 |
| 3,749,019 | | 7/1973 | Hancock et al. | 102/34.4 |
| 3,759,216 | | 9/1973 | Sanders | 116/114 |
| 3,820,462 | * | 6/1974 | Jackson, Jr. | 102/342 |
| 3,855,930 | * | 12/1974 | Mulich et al. | 102/342 |
| 4,222,306 | * | 9/1980 | Maury | 102/342 X |
| 4,805,533 | * | 2/1989 | Herold et al. | 102/342 X |
| 5,631,441 | | 5/1997 | Briere et al. | 102/336 |

* cited by examiner

*Primary Examiner*—Peter A. Nelson
(74) *Attorney, Agent, or Firm*—Stout, Uxa, Buyan & Mullins, LLP

(57) ABSTRACT

A flare apparatus including a shell case, an explosive assembly carried by the shell case, a flare cup located in the shell case and spaced apart from the first end of the shell case and having a closed end surface away from the first end of the shell case which is convex, a flare composition located in the interior space defined by the flare cup and a plug located in the interior chamber defined by the shell case and being in close proximity to the flare cup. The present flares are straightforward in construction, easy and inexpensive to produce and provide substantial performance benefits and substantial shipping/transporting benefits. In particular, the present flares are safer to ship/transport relative to conventional flares and can be shipped/transported under less restrictive conditions.

22 Claims, 1 Drawing Sheet

ENHANCED FLARE APPARATUS

BACKGROUND OF THE INVENTION

The present invention relates to flare apparatus. More particularly, the invention relates to such apparatus to provide a signal, for example, in the form of a 12-gauge flare.

Flares are well known as signaling devices, for example, to warn of distress in an emergency, to signal one's location, to provide a specific, e.g., color coded, message and the like. One common flare device is known as a 12-gauge flare, because it resembles a 12-gauge shot gun shell in appearance. Such conventional flares include a so-called flare cup or cover which contains the propellant/signal creating chemicals. The flare cups of these conventional flare devices have a flat closed end. Also, the cup is wrapped or adhered to the shell casing. Thus, when the flare is activated, the flare cup separates from the shell casing and the flare cup and chemicals are propelled into the air where the appropriate signal is given.

Such prior flare devices have a number of draw backs. For example, they tend to be relatively difficult and expensive to produce and to have relatively widely varying, e.g., inconsistent, performance characteristics. In addition, such flares often do not achieve the height or altitude desired. The signal provided by a flare of this type can be seen from a further distance if it achieves a greater altitude.

An additional problem with many prior signal flares involves shipping or transporting such items. For example, the U.S. Department of Transportation requires that signal flares pass various tests before they can be shipped on commercial aircraft and/or other convenient modes of transportation. One such test involves placing a number of flares in a fire and monitoring the number of flare projectiles which result and how far (distance) from the fire such projectiles travel. Failure to pass this test can lead to a requirement that the signal flares be transported, if at all, in restricted heavy duty containers and/or on restricted vehicles. Ultimately, failure to pass such tests can adversely affect the commercial viability of the signal flares.

There continues to be a need to provide new flares, particularly high performance signal flares which can be conveniently and cost effectively shipped/transported.

SUMMARY OF THE INVENTION

New flare apparatus have been discovered. The present apparatus address one or more of the problems with prior flares, noted above. The present flare apparatus are easy and cost effective to produce, provide performance benefits, e.g. increased consistency or reproducibility in use from one flare to another, and/or achieve higher altitude upon activation, relative to prior flares, and can be conveniently and cost effectively shipped/transported. In short, the flare apparatus of the present invention provide one or more substantial advantages relative to prior flares.

In general, the present flare apparatus comprise a shell case or casing, an explosive assembly, a flare cup or cover, a flare composition, and a plug. The shell case has a peripheral inner surface, a first end and a opposing second end which is open. The shell case, preferably made of polymeric material, defines an interior chamber which is open at the second end. The explosive assembly is carried by the shell case at or near the first end and is located and adapted, upon activation, to cause gas to pass into the interior chamber. In one particularly useful embodiment, the explosive assembly includes a shot shell primer.

The flare cup is located in the interior chamber and is spaced apart from the first end of the shell case. Having the flare cup spaced apart from the first end of the shell case provides shipability advantages. For example, if the signal flare is exposed to a flame, for example, as in the above-noted U.S. Department of Transportation test, the heat from the flame tends to melt and/or deform the shell case before ignition, thereby reducing the risk that a projectile from the flare will result or that the projectile will travel more than an acceptable distance from the fire.

This reduced projectile risk results in the present flares being subject to less strict shipping regulations, for example, relative to certain prior signal flares. In addition, the wall or walls of the shell case, particularly at and near the first end of the shell case, preferably are of reduced thickness to facilitate the degradation, e.g., melting and/or deforming, of the shell case in the event of an external fire. The present flares preferably are acceptable for being shipped/transported on commercial, even passenger, aircraft, and/or in less restrictive, e.g., less bulky and/or heavy, containers than have been required for certain prior signal flares.

The flare cup is simply located in the interior chamber formed or defined by the shell case. The flare cup preferably is in close proximity to the inner peripheral surface of the shell case. Such arrangement provides a very convenient and straightforward approach to coupling these two components, that is the shell case and the flare cup. Moreover, no adhesives or wrappings are required. Further, this arrangement allows the flare cup to be separated from the shell case very effectively and consistently, from flare to flare, using the explosive assembly, as described hereinafter.

In one embodiment, the flare cup defines an interior space, and has an open end and a closed end surface, which is preferably convex, located opposite the open end of the flare cup. Having a convex closed end surface on the flare cup improves the aerodynamic properties of the flare projectile, that is the flare cover or cup and its contents after the flare cup has separated from the shell case. Ultimately, such convex closed end surface, alone and/or in combination with one or more other features of the present flare apparatus, provide an enhanced ability of the present flare apparatus to achieve higher altitudes relative to prior art flares of a similar type, for example, which include flare cups with flat end surfaces.

The flare composition is located in the interior space of the flare cup, and preferably comprises magnesium. The flare composition is effective, when ignited, to provide a visual indication from the projectile including at least a portion of the flare cup. A fire composition, which preferably comprises gun powder and magnesium, preferably is situated on or in proximity to the flare composition. The fire composition is effective, when ignited, to propel the flare cup away from the shell case and to ignite the flare composition.

The present flare apparatus include a plug located in the interior chamber of the shell case. Such plug is adapted to hold the flare cup in the interior chamber prior to activation of the explosive assembly. The plug preferably is sized and adapted to seal the flare cup and flare composition from moisture. This is beneficial to the general performance, and to the reliability and consistency of performance of the present flare apparatus. In a particularly useful embodiment, the plug includes a case located in close proximity to, for example, in contact with, the closed end of the flare cup. A peripheral structure is provided and extends from the case away from the flare cup. At least a portion of the peripheral structure preferably is in contact with the inner peripheral surface of the shell case.

The present plug preferably provides a seal to increase pressure in the interior chamber and increase muzzle velocity when the flare apparatus is fired. The reverse design of the plug, as set forth above, facilitates the sealing of the flare cup and flare composition from moisture and allows for quick removal from the head or top of the projectile including at least a portion of the flare cup upon exiting the shell case when fired. This reduces the drag caused by the plug and results in a higher altitude of the projectile. In effect, enhanced flare performance is achieved with such reverse design plug.

Preferably the present flare apparatus includes shell cases and plugs which are made of polymeric materials, preferably thermoplastic polymeric materials, and/or flare cups made of metal, preferably aluminum. In one particularly useful embodiment, the shell case is made of high impact acrylonitrile/butadiene/styrene (ABS) polymeric material. Of course, it should be understood that other suitable materials of construction for each of the shell case, plugs and flare cup can be employed.

The shell case preferably extends beyond the plug a distance sufficient so that the projectile is propelled further or higher relative to a similar flare apparatus in which the shell case terminates at the plug. The portion of the shell case extending beyond the plug preferably is a smooth bore shell casing. The overall length of this extended portion of the shell case may be varied depending on the desired increase in muzzle velocity and flare projectile altitude desired.

In one very useful embodiment, the present shell case includes an inwardly extending projection or step sized and adapted to maintain the flare cup spaced apart from the first end of the shell case. Thus, in this embodiment, the open end of the flare cup is in contact with or rests on this inwardly extending step and is thus prevented from moving further down toward the first end of the shell case.

The flare apparatus preferably further comprises gun powder located in the interior chamber between the peripheral inner surface of the shell case and the explosive assembly. This gun powder, e.g., black powder, is effective to assist in the propulsion of the flare cup projectile when ignited by the explosive assembly. Also, such powder may provide additional heat to degrade the shell case in the event of an external fire. Thus, such powder provides the flare apparatus with shipping/transporting benefits.

The flare cup preferably includes an outer sidewall configured as a right circular cylinder. This configuration provides for ease of manufacturing and enhances the aerodynamic properties of the flare projectile.

The flare composition preferably includes a curved, more preferably convex, surface relative to the first end of the shell case. Such curved, and preferably convex, surface provides an increased surface area for ignition of the flare composition. Such increased surface area provides for a more rapid ignition of the flare composition which results in a more timely signal being provided by the flare apparatus and, in addition, may enhance the achieving of higher altitudes.

Each and every feature described herein and combination of two or more of such features are included within the scope of the present invention, provided that the features included in any such combination are not mutually inconsistent.

These and other advantages of the present invention are apparent in the following detailed description and claims, particularly when considered in conjunction with the accompanying drawings in which like parts bear like reference numerals.

DETAILED DESCRIPTION OF PREFERRED EMBODIMENT

Figure 1:
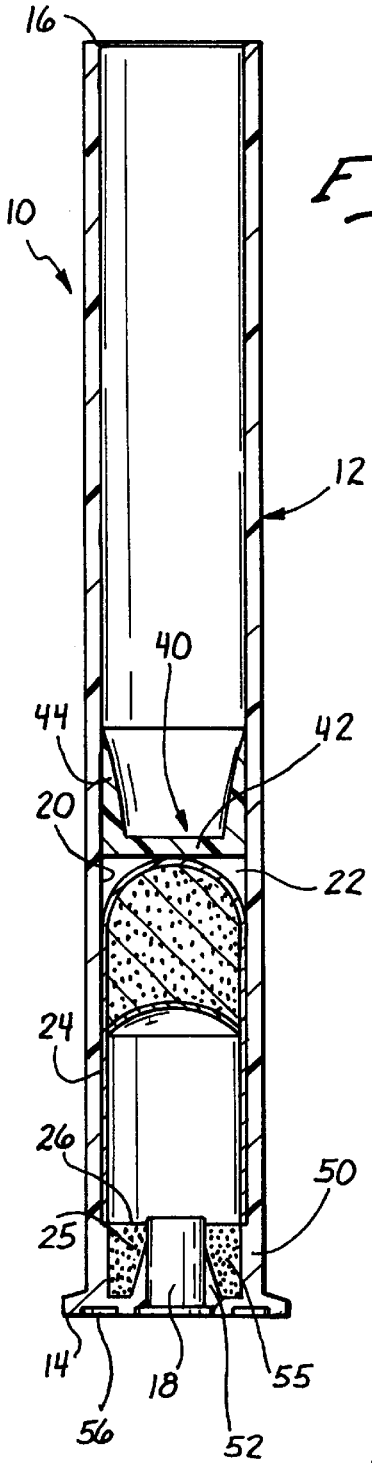
FIG. 1 is a cross-sectional view of a 12-gauge flare shell in accordance with the present invention.
Figure 2:
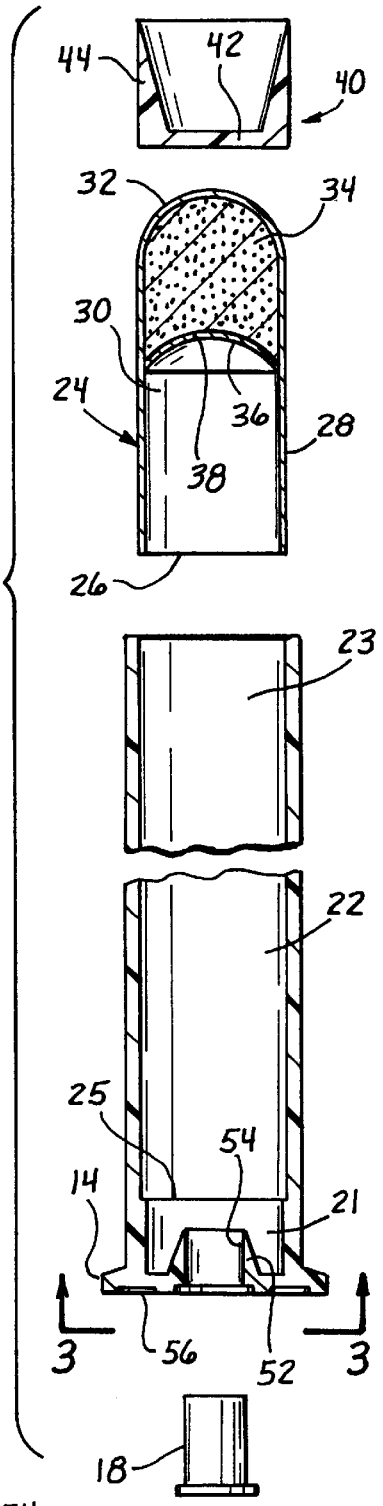
FIG. 2 is an exploded view in cross-section of the 12-gauge flare shell of FIG. 1.

Referring now to FIGS. 1 and 2, a flare apparatus in accordance with the present invention, shown generally at 10, includes a shell case 12, preferably made of substantially rigid polymeric material, such as high impact ABS thermoplastic polymeric material. Shell case 12 includes a generally circular first end 14 and an opposing, generally circular, second end 16 which is open. A conventional 209 shot shell primer 18 is situated in the shell case 12 such that the primer is exposed at the first end 14 of the shell case.

The shell case 12 includes a generally circular cylindrical interior peripheral surface 20 and an interior chamber 22. The surface 20 has a first portion 21 near the first end 14 and second portion 23 near the second end 16. Second portion 23 defines a larger cross-section than the first portion 21. An inwardly extending projection or step 25 of surface 20 is located between first portion 21 and second portion 23.

An aluminum flare cup or cover 24 is located in the interior chamber 22 with the open end 26 of the flare cup in contact with step 25, as shown in FIG. 1. In this manner, flare cup 24 is maintained spaced apart from the first end 14 of shell case 12. The flare cup 24 has a generally circular cylindrical peripheral surface 28, includes an interior space 30 and a closed end surface 32 which is curved, in particular, convex, and is located opposite the open end 26.

A flare mix or composition 34 is located in the upper portion of the interior space 26 of the flare cup 24, in particular, near the curved end surface 32 of the flare cup. This flare composition 34 includes magnesium, as well as other conventional additives, such as accelerants, colorants and the like. A layer of fire mix or composition 36 is located on the flare composition 34 and includes a curved surface 38 which faces the first end 14 of the shell case 12. Curved surface 38 is convex relative to first end 14. This fire mix 36 includes gun powder and magnesium. The flare composition 34 and fire mix 36 can be of conventional and well known chemical make-ups.

Plug 40, preferably made of low density polyethylene, is located in the interior chamber 22 of shell case 12. Plug 40 is a unitary item and includes a case plate 42 which is located in close proximity to, preferably in contact with, the closed end surface 32 of flare cup 24. Peripheral member 44 circumscribes case plate 42 and extends from the case plate away from the flare cup 24. Peripheral member 44 is sized to fit snugly into the interior chamber 22 defined by inner wall 20 of shell case 12. With plug 40 positioned in interior chamber 22, as shown in FIG. 1, flare cup 24 is held in place and it and its contents are sealed from moisture by the plug.

The portion 50 of shell case 12 located between first end 14 and step 25 is maintained at a relatively reduced thickness. In addition, the shell case 12 includes a central structure 52 extending upwardly from the first end 14. This central structure 52 defines a primer chamber 54 into which is placed, for example, interference fit, primer 18. The space between central structure 52 and portion 50 of shell case 12 is filled with conventional gun powder 55.

Figure 3:
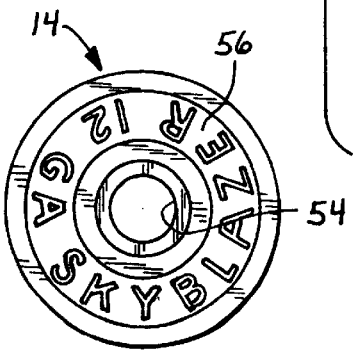
FIG. 3 is a view taken generally along line 3—3 of FIG. 2.

Referring to FIGS. 1, 2 and 3, first end 14 includes a region 56 of reduced thickness. In the embodiment shown, this reduced thickness region 56 includes raised lettering. The reduced thickness region 56 facilitates the degradation of the shell case 12 in the event of an external fire.

The flare 10 can be produced using conventional manufacturing and assembly techniques, for example, polymer molding for the shell case 12 and plug 40, metal shaping for the flare cup 24, filling and coating and/or pressing for the flare composition 34 and fire mix 36.

The following procedure may be employed to produce 12-gauge flares in accordance with the present invention. This procedure is used to produce a batch of about 4,000 flares. However, the amounts of each material shown are the amounts per individual 12-gauge flare.

Magnesium particles are doped with cellulose nitrate. Two types of magnesium particles are employed. The first particles, sized at 50/100 mesh, are coated with cellulose nitrate by combining the magnesium particles with a solution including cellulose nitrate and acetone. The mixture is tumbled for a period of time and the acetone is evaporated. 1.3 grams of the doped 50/100 mesh magnesium particles is used in the flare composition per flare.

Similarly, magnesium particles sized at 100/200 mesh are coated with cellulose nitrate. 0.57 grams of the doped 100/200 mesh magnesium particles is used per flare.

These two differently sized doped magnesium particles are combined with 1.27 grams of strontium nitrate, 0.5 grams of a polyvinyl chloride-cased binder, 1.9 grams of a conventional oxidizer, such as that sold by Pearson Sales under the trade name Dextrin grade 1751-S, and 0.32 grams of potassium perchlorate. This combination of materials is blended to provide a uniform flare composition.

The fire mix is produced by combining 0.22 grams of the cellulose nitrate doped 100/200 mesh magnesium particles with 0.17 grams of strontium nitrate, 0.07 grams of the polyvinyl chloride-cased binder, 0.025 grams of the conventional oxidizer, 0.025 grams of potassium perchlorate, and 0.18 grams of 4 F black powder. These materials are mixed together to form a uniform fire mix.

The individual 12-gauge flares are produced by placing the appropriate amount of the flare composition into the closed end of the aluminum cup 24. The appropriate amount of the fire mix is then placed in the aluminum cup. A convex-faced punch is used to compress the flare composition and flare mix into the closed end of the aluminum cup 24, as shown in FIGS. 1 and 2. After this, the flare cup 24 is placed in the interior chamber 22 so that the open end 26 of the flare cup is in contact with the step 25. Plug 40 is passed into interior chamber 22 so that case plate 42 comes in contact with flare cup 24, as shown in FIG. 1. The shot shell primer 18 is put in place in the shell case 12, as shown in FIG. 1.

At this point, the flare has been assembled and is ready to be shipped/transported to the ultimate consumer for use.

The flare 10 is used by placing it in a flare launcher, for example, of conventional design. An impact is caused which results in the shot shell primer 18 exploding. This explosion creates hot gases in the interior chamber 22 which ignite the fire mix 36. The ignited fire mix 32 provides a propellent for the flare cup 24 and creates sufficient heat to ignite the flare composition 34. The length of the shell case 12 beyond the plug 40 is selected so as to control the muzzle velocity and/or ultimate projectile altitude. Within a range of about 4 inches or less, the longer this length, the higher the muzzle velocity and the greater ultimate projectile altitude.

As the flare cup projectile and plug 40 leave the second end 16 of shell case 12, the plug 40 quickly separates from the projectile. With the flare cup projectile in the air, the flare composition 34 burns with sufficient intensity to melt the aluminum flare cup 24 and provides a visual signal or indication, similarly to conventional 12-gauge flares.

The present invention provides substantial advantages relative to conventional flare systems. For example, the present flare 10 provides a very cost effective and performance effective approach for holding the flare shell together prior to activation and, when the shot shell primer is exploded, for reliably and consistently providing a flare projectile having the desired altitude and signal providing characteristics. In addition, one or more of the facts that the flare cup 24 is spaced apart from the first end 14 of the shell case 12, that the first end 14 includes a region 56 of reduced thickness and/or that gun powder 54 is located between the shot shell primer 18 and the shell case portion 50 provide the flare apparatus 10 with improved shipability/transportability. In particular, in the event of an external fire, the present flares are constructed so as to reduce the risk of allowing projectiles, such as flare cup 24 and its contents and/or shot shell primer 18 from traveling distances which are considered to be unsafe. In effect, the present flare apparatus are constructed to have enhanced safety during shipping/transporting of such apparatus.

While this invention has been described with respect to various specific examples and embodiments, it is to be understood that the invention is not limited thereto and that it can be variously practiced within the scope of the following claims.

What is claimed is:

1. A flare apparatus comprising:

a shell case having a peripheral inner surface, a first end and an opposing second end which is open, said shell case defining an interior chamber which is open at said second end;

a shell shot primer carried by said shell case at or near said first end and located and adapted, upon activation, to cause gas to pass into said interior chamber;

a flare cup which is located in said interior chamber and is spaced apart from said first end of said shell case, said flare cup defining an interior space and having an open end and a closed end surface located opposite said open end;

a flare composition located in said interior space and effective, when ignited, to provide a visual indication from a projectile including at least a portion of said flare cup; and a plug located in said interior chamber and adapted to hold said flare cup in said interior chamber prior to activation of said shell shot primer.

2. The flare apparatus of claim 1 wherein said shell case is made of polymeric material.

3. The flare apparatus of claim 1 wherein said shell case extends beyond said plug a distance sufficient so that the projectile is propelled further relative to a similar flare apparatus in which the shell case terminates at the plug.

4. The flare apparatus of claim 1 wherein said shell case includes an inwardly extending projection sized and adapted to contact said flare cup and to maintain said flare cup spaced apart from said first end of said shell case.

5. The flare apparatus of claim 1 which further comprises gun powder located in said interior chamber between said peripheral inner surface and said shell shot primer.

6. The flare apparatus of claim 1 wherein said first end of said shell case includes one or more regions of reduced thickness at least partially axially aligned with said interior chamber.

7. The flare apparatus of claim 1 in a form of a 12 gauge flare.

8. The flare apparatus of claim 1 wherein said flare cup is made of aluminum.

9. The flare apparatus of claim 1 wherein said flare cup includes an outer sidewall configured as a right circular cylinder.

10. The flare apparatus of claim 1 wherein said closed end surface of said flare cup is convex.

11. The flare apparatus of claim 1 wherein said flare composition includes magnesium.

12. The flare apparatus of claim 1 which further comprises a fire composition on or in proximity to said flare composition, said fire composition being effective, when ignited, to assist in propelling said flare cup away from shell case, and to ignite the flare composition.

13. The flare apparatus of claim 12 wherein said fire composition is located on said flare composition, includes a convex surface relative to said first end of said shell case, and includes gun powder and magnesium.

14. The flare apparatus of claim 1 wherein said plug is sized and adapted to seal said flare cup and said flare composition from moisture.

15. The flare apparatus of claim 1 wherein said plug includes a case extending across a major portion of an axial cross-section of said interior chamber and located in close proximity to said closed end surface of said flare cup and a peripheral structure extending from said case away from said flare cup, at least a portion of said peripheral structure being in contact with said inner peripheral surface of said shell case.

16. The flare apparatus of claim 1 wherein said plug is made of polymeric material.

17. A flare apparatus comprising:

a shell case having a peripheral inner surface, a first end and an opposing second end which is open, said first end including one or more regions of reduced thickness, said shell case including an inwardly extending step spaced apart from said first end and said shell case defining an interior chamber which is open at said second end, said one or more regions of reduced thickness being at least partially axially aligned with said interior chamber and being effective to facilitate degradation of said shell case in the event of an external fire;

an explosive assembly carried by said shell case at or near said first end and located and adapted, upon activation, to cause gas to pass into said interior chamber;

a flare cup which is located in said interior chamber and in contact with said step of said shell case, said flare cup defining an interior space and having an open end and a closed end surface located opposite said open end;

a flare composition located in said interior space and effective, when ignited, to provide a visual indication from a projectile including at least a portion of said flare cup;

a plug located in said interior chamber and adapted to hold said flare cup in said interior chamber prior to activation of said explosive assembly; and gun powder located in said interior chamber between said peripheral inner wall and said explosive assembly.

18. The flare apparatus of claim 17 wherein said shell case extends beyond said plug a distance sufficient so that the projectile is propelled further relative to a similar flare apparatus in which the shell case terminates at the plug.

19. A flare apparatus comprising:

a shell case having a peripheral inner surface, a first end and an opposing second end which is open, said shell case defining an interior chamber which is open at said second end;

an explosive assembly carried by said shell case at or near said first end and located and adapted, upon activation, to cause gas to pass into said interior chamber;

a flare cup which is located in said interior chamber and is spaced apart from said first end of said shell case, said flare cup defining an interior space and having an open end and a closed end surface located opposite said open end;

a flare composition located in said interior space and effective, when ignited, to provide a visual indication from a projectile including at least a portion of said flare cup; and a plug located in said interior chamber and adapted to hold said flare cup in said interior chamber prior to activation of said explosive assembly, said plug being sized and adapted to seal said flare cup and said flare composition from moisture, said plug includes a case extending across a major portion of an axial cross section of said interior chamber and located in close proximity to said closed end surface of said flare cup and a peripheral structure extending from said case away from said flare cup, at least a portion of said peripheral structure being in contact with said inner peripheral surface of said shell case, and said shell case extends beyond said plug a distance sufficient so that the projectile is propelled further relative to a similar flare apparatus in which the shell case terminates at the plug.

20. The flare apparatus of claim 19 wherein said first end of said shell case includes one or more regions of reduced thickness at least partially axially aligned with said interior chamber, said one or more regions of reduced thickness being effective to facilitate degradation of said shell case in the event of an external fire.

21. The flare apparatus of claim 19 in a form of a 12 gauge flare.

22. The flare apparatus of claim 17 in a form of a 12 gauge flare.

* * * * *